US005407905A

United States Patent [19]

Das

[11] Patent Number: 5,407,905

[45] Date of Patent: Apr. 18, 1995

[54] HIGH TC SUPERCONDUCTING HIGH POWER COUPLERS

[76] Inventor: Satyendranath Das, P.O. Box 6223, Washington, D.C. 20015-0223

[21] Appl. No.: 135,398

[22] Filed: Oct. 13, 1993

[51] Int. Cl.[6] ..... H01P 5/18; H01B 12/02

[52] U.S. Cl. ..... 505/210; 505/700; 505/866; 333/114; 333/99 S

[58] Field of Search ..... 333/114, 99 S; 505/202, 505/204, 210, 700, 701, 866

[56] References Cited

U.S. PATENT DOCUMENTS 2,478,317 8/1949 Purcell ..... 333/114
2,870,419 1/1959 Riblet ..... 333/114

FOREIGN PATENT DOCUMENTS 68101 3/1989 Japan ..... 333/229
251903 10/1989 Japan ..... 333/227

*Primary Examiner*—Benny T. Lee

[57] ABSTRACT

To reduce losses of commercial room temperature couplers, high Tc superconducting waveguides and waveguide flanges are used for couplers. There are two approaches for making these high Tc superconducting waveguide structures. One is to use a single crystal such as YBaCuO (YBCO), cut and machine the crystal to the desired shape, and use high Tc superconducting flanges. In the second method, a good quality dielectric, such as sapphire is used and cut and machined to the desired shape. The conducting surfaces are coated with a single crystal high Tc superconducting material such as YBCO. The waveguides are brazed together. Low loss is important particularly for high power couplers. Significant amount of RF power is lost even with a low loss coupler. The high Tc superconducting couplers will provide a significant benefit in high power RF systems handling power levels such as 0.5 megawatts.

6 Claims, 2 Drawing Sheets

HIGH TC SUPERCONDUCTING HIGH POWER COUPLERS

FIELD OF INVENTION

The present invention relates to couplers of electromagnetic waves and more particularly to RF couplers.

In many electromagnetic systems, it is often necessary to couple signal from one circuit to another circuit.

For high power applications, waveguide couplers are used. In one configuration, a main waveguide section is connected to a branch waveguide section on the broadside of the main waveguide with an appropriate angle between them and an appropriate coupling hole between the main and the branch waveguides. The angle between the two waveguides and the size of the hole determines the performance of the waveguide coupler. This type of coupler is commonly known as the Bethe hole coupler. In U.S. Pat. No. 2,478,317 Purcell claimed such a coupler. In the U.S Pat. No. 2,478,317 it is stated that the optimum value of the angle between the coupled waveguides at which high directivity is secured is determined by the operating frequency, the thickness of the common wall, and the size and shape of the coupling aperture. This type of couplers is also discussed in other documents. P. A. Rizzi, Microwave Engineering passive circuits, Prentice Hall, Engelwood Cliffs, N.J. 07632.

In the high Tc superconducting high power couplers, the conducting surfaces are made of or deposited with a high Tc superconducting material significantly reducing the losses. In one version, the waveguides are made of a high Tc superconducting single crystal material such as YBCO. In another version, the waveguides are made of a low-loss single crystal dielectric such as sapphire the conducting surfaces of which are deposited with a film of a single crystal high Tc superconducting material such as YBCO. The waveguide flanges are also made of or deposited with a high Tc superconducting material. The waveguide sections are brazed together at the connecting surfaces. By the use of a single crystal high Tc superconducting material, the surface resistance of the coupler is reduced at least by a factor of ten as compared to the room temperature couplers.

SUMMARY OF THE INVENTION

The purpose of the present invention is to provide couplers with losses significantly lower than the available commercial, room temperature couplers of similar design.

In one configuration, a main waveguide section is used for transmission of a signal. A branch waveguide is used for coupling the signal in the forward direction, and is brazed on the broadside of the main waveguide with an appropriate hole between them. The two waveguides are connected with an appropriate angle between them.

The interior of the waveguides is deposited with a film of a single crystal high Tc superconducting material. There are, at least, two approaches for this. In one method, each of the waveguide section is made of a high Tc superconducting single crystal material such as YBCO. Each waveguide flange is also made of a high Tc superconducting single crystal such as YBCO. In the second version, each waveguide section is made of a high quality single crystal dielectric such as sapphire the conducting surfaces of which are deposited with a film of a single crystal high Tc superconducting material.

With these and other objectives in view, as will hereinafter be more particularly pointed out in detail in the appended claims, reference is now made to the following description taken in connection with accompanying diagrams.

Figure 1:
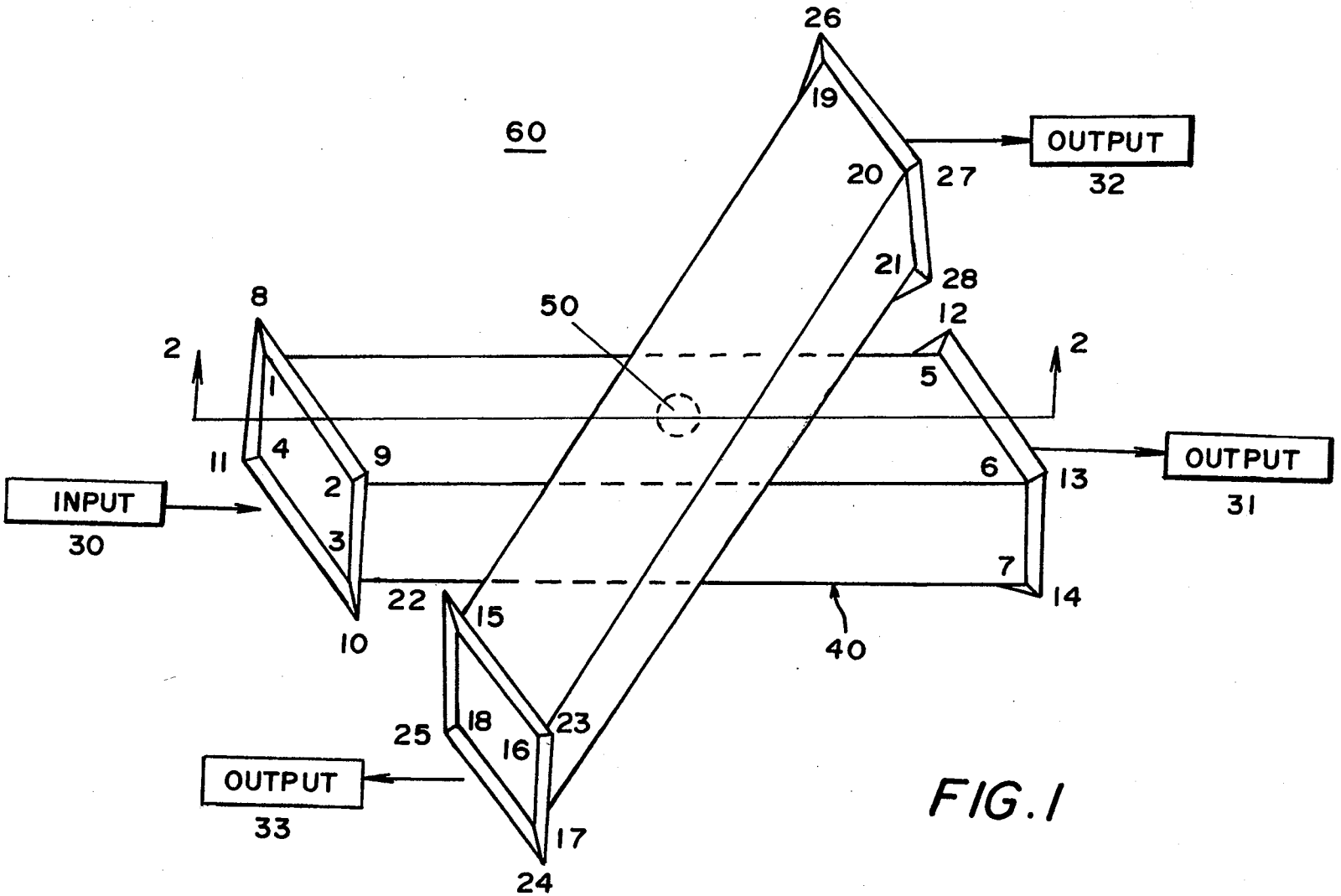
FIG. 1 is a typical, pictorial, schematic embodiment of a coupler.

Now referring to the drawings, there is illustrated in FIG. 1, a typical microwave or millimeter wave configuration that incorporates the principles of the present invention. Circuit 60 includes an RF input 30, an RF transmission line 40 and a direct RF output 31 and a coupled output 32.

The circuit 60 might be a part of a cellular, radar, terrestrial microwave, satellite, radio navigation, radio determination or other telecommunications system. The RF input 30 may represent a signal generator or transmitter which launches a telecommunication signal onto a transmission line 40 for transmission to a direct output 31 and a coupled output 32.

The high Tc, currently between 77°–105° K., superconducting high power coupler is made of a main waveguide and a branch waveguide the conducting surfaces of which are deposited with a film of or made up of a single crystal high Tc superconducting material.

The transmission line 40 contains an input main waveguide section 1, 2, 3, 4 and a main waveguide output section 5, 6, 7. A branch waveguide is connected to the broadside of the main waveguide with an appropriate hole 50 coupling the two waveguides. The branch waveguide is connected at an appropriate angle with the main waveguide.

The coupled output section of the branch waveguide is 19, 20, 21. The unwanted reverse direction output section of the branch waveguide is 15, 16, 17, 18.

By designing the (1) size of the coupling hole and (2) angle between the branch and the main waveguides, the (a)amount of the desired coupled output and (b) amount of undesired output 33 in the reverse direction are controlled. A good coupler is designed to have a low undesired output in the reverse direction. The angle between the coupled waveguides is determined by (1) the size of the coupling hole, (2) the operating frequency and (3) the thickness of the common wall as stated in the U.S. Pat. No. 2,478,317.

The input waveguide flange is 8, 9, 10, 11. The output main wave guide flange is 12, 13, 14. The output branch waveguide flange is 26, 27, 28. The reverse direction branch waveguide flange is 22, 23, 24, 25. Metallic supports are provided outside the couplers for giving, if needed, additional mechanical support.

In one configuration, the waveguide sections and the waveguide flanges are made of a high Tc superconducting single crystal material such as YBCO. In a second configuration, the waveguide sections and waveguide flanges are all made of a good quality single crystal material such as sapphire and all conducting surfaces are deposited with film of a single crystal high Tc superconducting material such as YBCO.

Figure 2:
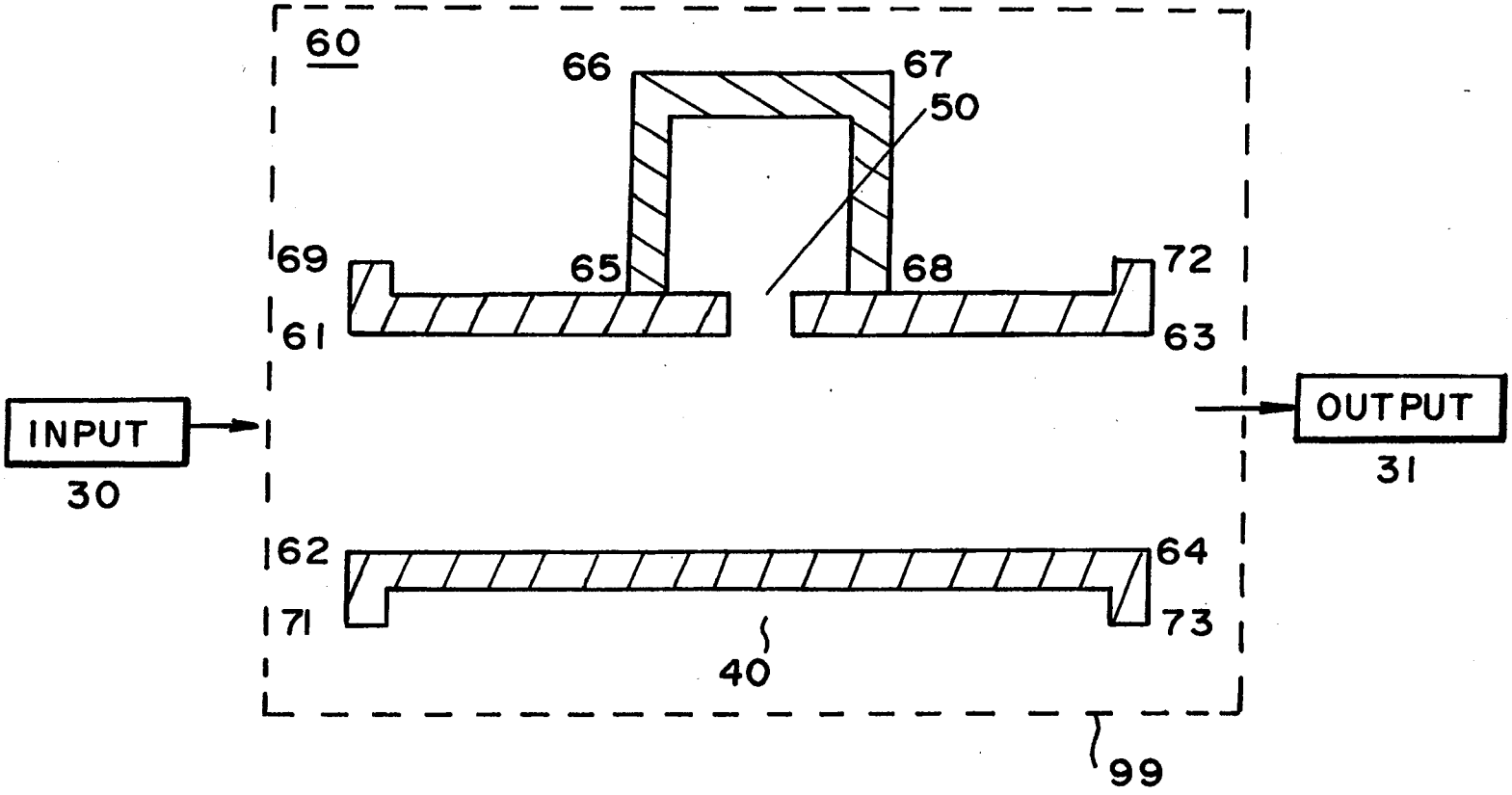
FIG. 2 is a longitudinal section through the main waveguide transmission line.

There is illustrated in FIG. 2 a typical longitudinal cross-section of a microwave or millimeter wave configuration that incorporates the principles of the present invention. The circuit 60 contains an input 30, a transmission line 40 and an output 31. The transmission line contains the input waveguide section 61, 62 and an output waveguide section 63, 64. The branch waveguide section is 65, 66, 67, 68 mounted on the broadside of the main waveguide with an appropriate hole 50 coupling the main waveguide and the branch waveguide sections.

The input flange is 69, 61 and 62, 71. The output flange is 72, 63 and 64, 73.

All the conducting surfaces of the waveguide sections and waveguide flanges are deposited with a film of or made of a high Tc superconducting single crystal material.

Element 99 is the means for keeping the coupler at the high superconducting Tc.

It should be understood that the foregoing disclosures relate to only typical embodiments of the invention and that numerous modifications or alternatives may be made therein, by those of ordinary skill, without departing from the spirit and the scope of the invention as set forth in the appended claims.

What is claimed is:

1. A high Tc superconducting rectangular waveguide coupler having a branch rectangular waveguide, an input and outputs, and comprising of:

a body of a high Tc superconducting rectangular waveguide main transmission line having a broadside;

a first RF transmission means for coupling RF energy into said body at the input;

a second RF transmission means for coupling RF energy from said body at a first one of the outputs;

a body of a high Tc superconducting branch rectangular waveguide mounted on the broadside of the main waveguide section at an appropriate angle thereto;

an appropriate coupling hole, provided in said broadside, between the main and the branch waveguide sections;

a third RF transmission means for coupling output energy from the branch rectangular waveguide section at a second one of the outputs;

a fourth RF transmission means, which being unterminated, for coupling unwanted reverse direction energy from the branch rectangular waveguide section at a third one of the outputs;

flanges being connected to the said main transmission line and the branch rectangular waveguide at the input and the outputs thereof;

said high Tc superconducting main and branch waveguides being comprised of a high Tc superconducting single crystal;

said high Tc superconducting waveguide flanges being comprised of single crystal high Tc superconducting materials; and means for keeping the high Tc superconducting couplers at a high Tc superconducting temperature.

2. A high Tc superconducting rectangular waveguide coupler of claim 1, having a branch rectangular waveguide, an input and outputs; and said fourth transmission means for terminating in a matched load unwanted reverse direction energy from the branch rectangular waveguide section.

3. A high Tc superconducting rectangular waveguide coupler of claim 1, having a branch rectangular waveguide, an input and outputs wherein the said single crystal high Tc superconducting material being YBCO.

4. A high Tc superconducting rectangular waveguide coupler comprised of a single crystal dielectric material having conducting surfaces which are deposited with a film of a high Tc superconductor, having a branch rectangular waveguide, an input and outputs, and comprising of:

a body of a high Tc superconducting rectangular waveguide main transmission line having a broadside;

a first RF transmission means for coupling RF energy into said body at the input;

a second RF transmission means for coupling RF energy from said body at a first one the outputs;

a body of high Tc superconducting branch rectangular waveguide mounted on the broadside of the main waveguide section at an appropriate angle thereto;

an appropriate coupling hole, provided in said broadside, between the main and the branch rectangular waveguide sections;

a third RF transmission means for coupling output energy from the branch rectangular waveguide section at a second one of the outputs;

a fourth transmission means, which being unterminated, for coupling unwanted reverse direction energy from the branch rectangular waveguide section at a third one of the outputs;

flanges being connected on the main transmission line and the branch waveguide at the input and the outputs thereof;

said high Tc superconducting rectangular, main and branch, waveguides being comprised of high quality dielectric single crystals the conducting surfaces of which are deposited with a film of a high Tc superconducting single crystal;

said high Tc superconducting waveguide flanges being comprised of high quality dielectric single crystals the conducting surfaces of which are deposited with a film of a high Tc superconducting single crystal material; and means for keeping the high Tc superconducting couplers at a high Tc superconducting temperature.

5. A high Tc superconducting rectangular waveguide coupler of claim 4, having a branch rectangular waveguide, an input and outputs wherein the said single crystal dielectric material being sapphire.

6. A high Tc superconducting rectangular waveguide coupler of claim 5, having a branch rectangular waveguide, an input and outputs wherein the said single crystal high Tc superconducting film being YBCO.

* * * * *